US009877135B2

(12) United States Patent
Backman et al.

(10) Patent No.: US 9,877,135 B2
(45) Date of Patent: Jan. 23, 2018

(54) METHOD AND APPARATUS FOR LOCATION BASED LOUDSPEAKER SYSTEM CONFIGURATION

(71) Applicant: Nokia Corporation, Espoo (FI)

(72) Inventors: Juha Reinhold Backman, Espoo (FI); Miikka Olavi Tikander, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 406 days.

(21) Appl. No.: 13/912,339

(22) Filed: Jun. 7, 2013

(65) Prior Publication Data

US 2014/0362995 A1 Dec. 11, 2014

(51) Int. Cl.
*H04S 7/00* (2006.01)
*H04R 5/04* (2006.01)

(52) U.S. Cl.
CPC ..... *H04S 7/301* (2013.01); *H04R 5/04* (2013.01); *H04R 2420/07* (2013.01)

(58) Field of Classification Search
CPC ..... H04M 1/7253; H04S 3/00; H04S 7/301; H04R 5/04; H04R 29/00; H04R 3/12; H04Q 7/20; H04W 24/00; G10L 19/02; G06T 7/2046
USPC ..... 381/17, 81, 80, 58; 704/270; 455/456.1, 455/41.2, 456, 422; 726/3
See application file for complete search history.

(56) References Cited

U.S. PATENT DOCUMENTS

| | | | | |
|---|---|---|---|---|
| 7,630,501 | B2 | 12/2009 | Blank et al. | |
| 8,199,941 | B2 | 6/2012 | Hudson et al. | 381/303 |
| 8,279,709 | B2 | 10/2012 | Choisel et al. | 367/127 |
| 8,316,154 | B2 | 11/2012 | Yoneda | |
| 9,277,321 | B2 * | 3/2016 | Toivanen | H04R 5/04 |
| 2002/0122003 | A1 | 9/2002 | Patwari et al. | |
| 2003/0119523 | A1 * | 6/2003 | Bulthuis | H04S 7/301 455/456.1 |
| 2004/0034655 | A1 * | 2/2004 | Tecu | G10L 19/02 |
| 2004/0071294 | A1 | 4/2004 | Halgas, Jr. et al. | |
| 2004/0209654 | A1 | 10/2004 | Cheung et al. | |
| 2005/0190928 | A1 | 9/2005 | Noto | |
| 2007/0116306 | A1 | 5/2007 | Riedel et al. | |

(Continued)

FOREIGN PATENT DOCUMENTS

| | | | |
|---|---|---|---|
| EP | 1894439 | B1 | 8/2010 |
| WO | WO-2006131894 | A2 | 12/2006 |
| WO | WO-2011/144795 | A1 | 12/2011 |

OTHER PUBLICATIONS

Koskela, et al.; *Evolution Towards Smart Home Environments Empirical Evaluation of Three User Interfaces* ; Jul. 3-4, 2004; Institute of Software Systems, Tampere University of Technology, P.O. Box 553, 3101, Tampere, Finland; http://dl.acm.org/citation.cfm?id=1012660 (2 pages).

(Continued)

*Primary Examiner* — David Ton
*Assistant Examiner* — Ubachukwu Odunukwe
(74) *Attorney, Agent, or Firm* — Harrington & Smith

(57) ABSTRACT

In accordance with an example embodiment of the invention, a method is disclosed. Near field communication is detected between at least two devices. A location of at least one of the at least two devices is determined based on the detected near field communication. An audio channel of a multi-channel audio file is assigned based on the determined location of the at least one of the at least two devices.

20 Claims, 8 Drawing Sheets

(56) References Cited

U.S. PATENT DOCUMENTS

| | | | | |
|---|---|---|---|---|
| 2008/0019576 | A1* | 1/2008 | Senftner | G06T 15/00 382/118 |
| 2008/0177822 | A1 | 7/2008 | Yoneda | |
| 2008/0207123 | A1 | 8/2008 | Andersen | |
| 2008/0240460 | A1* | 10/2008 | Sugii | H04B 3/54 381/80 |
| 2009/0310790 | A1 | 12/2009 | Sinton et al. | |
| 2010/0105325 | A1* | 4/2010 | Halla | H04S 3/00 455/41.2 |
| 2010/0119072 | A1 | 5/2010 | Ojanpera | |
| 2010/0135118 | A1 | 6/2010 | Van Leest et al. | |
| 2010/0260348 | A1* | 10/2010 | Bhow | H04N 21/25891 381/81 |
| 2011/0191823 | A1* | 8/2011 | Huibers | H04W 4/00 726/3 |
| 2012/0128160 | A1 | 5/2012 | Kim et al. | |
| 2013/0044894 | A1 | 2/2013 | Samsudin et al. | |
| 2013/0130714 | A1* | 5/2013 | Huibers | H04W 24/00 455/456.1 |
| 2013/0226324 | A1 | 8/2013 | Hannuksela et al. | |
| 2013/0315405 | A1* | 11/2013 | Kanishima | H04R 29/00 381/58 |
| 2014/0050454 | A1 | 2/2014 | Slotte | |
| 2014/0133672 | A1* | 5/2014 | Lakkundi | H04R 3/12 381/80 |
| 2014/0169569 | A1* | 6/2014 | Toivanen | H04R 5/04 381/17 |
| 2014/0362995 | A1 | 12/2014 | Backman et al. | |

OTHER PUBLICATIONS

Raykar, et al.; IEEE Transactions on Speech and Audio Processing; *Position Calibration of Microphones and Loudspeakers in Distributed Computing Platforms*; Aug. 27, 2003; http://www.umiacs.umd.edu/labs/labs/cvl/pirl/vikas/publications/IEEETSAP_v12_onecolumn.pdf (29 pages).

Toivanen, et al.; U.S. Appl. No. 13/716,660, filed Dec. 17, 2012; *Device Discovery and Constellation Selection*.

"In Stereo", http://instereo.com.au/, (2011), (2 pages).

Summit Semiconductor, LLC, "SpeakerFinder Technology" Automated Home Theater Speaker Configuration and Setup, (Feb. 9, 2011), (14 pages).

http://store.sony.com/webapp/wcs/stores/servlet/StoreCatalogDisplay?langId=-1&storeId-10151&catal . . . ,(2012), (4 pages).

* cited by examiner

METHOD AND APPARATUS FOR LOCATION BASED LOUDSPEAKER SYSTEM CONFIGURATION

TECHNICAL FIELD

The invention relates to audio and, more particularly, to multi-channel (two or more) loudspeaker reproduction, indoor navigation, and near-field-communication (NFC).

BACKGROUND

An electronic device typically comprises a variety of components and/or features that enable users to interact with the electronic device. Some considerations when providing these features in a portable electronic device may include, for example, compactness, suitability for mass manufacturing, durability, and ease of use. Increase of computing power of portable devices is turning them into versatile portable computers, which can be used for multiple different purposes. Therefore versatile components and/or features are needed in order to take full advantage of capabilities of mobile devices.

Some electronic devices may be used with a multi-channel audio file which a listener seeks to play back. Richness when playing back the multi-channel audio file is enhanced by having the loudspeakers also properly placed, but the audio file is of course not tied to any particular set of loudspeakers. Additionally, in some instances the physical location of portable wireless speakers can be arbitrary. This can prevent the listener from experiencing an aimed spatial audio experience. Regardless of the listener's familiarity with specifics of audio technology, an aimed spatial experience is what people have come to expect from a 5:1 or even 7:1 arrangement for multi-channel audio related for example to watching movies. Hardwired speakers are typically spatially situated purposefully to achieve a proper surround sound. A similar spatial pre-arrangement of wireless loudspeakers with assigned audio channels tends to lose effectiveness over time when individual wireless loudspeakers are relocated away from the position designated for the surround-sound channel provided to it.

Additionally, whether the loudspeakers are wired or wireless those previous audio systems that rely on pre-arranged spatial positioning of the speakers had the centralized host device that is handling the audio file (for example, a conventional stereo amplifier or a host/master mobile phone) output different ones of the audio channels to different speakers or different speaker-hosting devices.

SUMMARY

Various aspects of examples of the invention are set out in the claims.

In accordance with one aspect of the invention, a method is disclosed. Near field communication is detected between at least two devices. A location of at least one of the at least two devices is determined based on the detected near field communication. An audio channel of a multi-channel audio file is assigned based on the determined location of the at least one of the at least two devices.

In accordance with another aspect of the invention, an apparatus is disclosed. The apparatus includes at least one processor and at least one memory including computer program code. The at least one memory and the computer program code configured to, with the at least one processor, cause the apparatus to perform at least the following, detect near field communication, determine a location of a device based on the detected near field communication, and assign a channel of a multi-channel audio file based on the determined location of the device.

In accordance with another aspect of the invention, a computer program product including a non-transitory computer-readable medium bearing computer program code embodied therein for use with a computer is disclosed. The computer program code includes code for detecting near field communication. Code for determining a location of a device based on the detected near field communication. Code for assigning a channel of a multi-channel audio file based on the determined location of the device.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

Example embodiments of the invention and its potential advantages are understood by referring to FIGS. 1 through 11 of the drawings.

The exemplary and non-limiting embodiments detailed below present a way for discovering the physical positions of different loudspeakers relative to one another, and then selecting an arrangement of those loudspeakers that is appropriate for playing back a multi-channel audio file. The arrangement has multiple distinct speakers, each outputting different channels of the unitary multi-channel audio file. For a better context of the flexibility of these teachings the examples below consider a variety of different-type of audio devices; some may be mobile terminals such as smart phones, some may be only stand-alone wireless speakers which may or may not have the capability of 'knowing' the relative position of other audio devices in the arrangement, and some may be MP3-only devices with some limited radio capability, to name a few non-limiting examples. So long as some other audio device has the capacity to discover neighboring audio devices, the discovering audio device can discover any other audio devices which themselves lack such discovering capability, learn the relative positions of all the various neighbor audio devices according to the teachings below, and then form an audio arrangement appropriate for the sound file to be played back. In the below examples any of the above types of host devices for a loudspeaker are within the scope of the term 'audio device', which refers to the overall host device rather than any individual loudspeaker unit. In some implementations each audio device may have wireless connectivity with the other audio devices, as well as the capability for sound reproduction/play back and possibly also sound capture/recording.

Any given audio device is not limited to hosting only one loudspeaker. In different implementations of these teachings any such audio device can host one loudspeaker which outputs only one of the audio multi-channels, or it may host two (or possibly more) loudspeakers which can output the same audio multi-channel (such as for example a mobile handset having two speakers which when implementing these teachings are considered too close to one another to output different audio multi-channels), or one audio device may host two (or possibly more) loudspeakers which each output different audio multi-channels (such as for example two speakers of a single mobile handset outputting different left- and right-surround audio channels). Other implementations may employ combinations of the above. In more basic implementations where individual audio devices are not distinguished in the discovery phase as having one or multiple loudspeakers, each host audio device may be assumed to have only one loudspeaker and the same audio channel allocated to the device is played out over all the loudspeakers hosted in that individual audio device.

Figure 1:
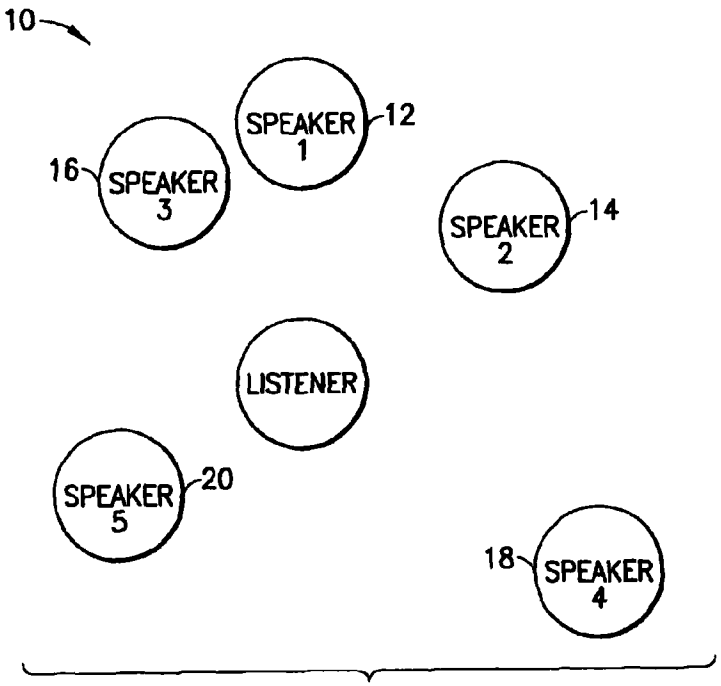
FIG. 1 is a schematic diagram showing an exemplary arrangement of audio devices incorporating features of the invention.

Referring to FIG. 1, there is shown an arrangement 10 of audio devices 12, 14, 16, 18, 20 incorporating features of the invention. The audio devices 12, 14, 16, 18, 20 each comprise at least one speaker (or loudspeaker). Although the invention will be described with reference to the exemplary embodiments shown in the drawings, it should be understood that the invention can be embodied in many alternate forms of embodiments. In addition, any suitable size, shape or type of elements or materials could be used.

FIG. 1 illustrates the arrangement 10 of audio devices for playing back a multi-channel audio file and in some cases also a multi-channel (3D) video file according to non-limiting embodiments of these teachings. While the specific examples of the teachings below are in the context of discovering multiple different audio devices and selection of an appropriate arrangement of those audio devices for playback of a multi-channel audio file, they are equally adaptable for playback of multi-channel video files as well as for establishing an appropriate arrangement of devices for capturing multi-channel audio and/or video (where microphones or cameras are assumed to be present in the respective audio devices of the examples below). Playback of a multi-channel video file assumes the video channels are provided to projectors or to a common display screen, which can be provided via wired interfaces or wireless connections. For audio-video multi-channel files the playback of audio and video are synchronized in the file itself, in which case synchronizing the audio playback among the various audio devices would result in synchronized video playback also.

The arrangement shown in FIG. 1 illustrates an example of how two or more audio devices could be used to output different channels of a multi-channel audio file (and/or video file) using the techniques detailed herein. According to various exemplary embodiments of the invention, the listener of audio and the viewer of video is ideally located at the center of the arrangement 10 to best experience the richness of the multi-channel environment. In some embodiments of the invention, the audio devices 12, 14, 16, 18, 20 may provide a center sound channel, right (front) and left (front) sound channels, and right surround (or rear right) and left surround (or rear left) sound channels, respectively. Additionally, in some embodiments the devices 12, 14, 16, 18, 20 may further comprise left and right video channels.

It should be noted that while various exemplary embodiments of the invention have been described in connection with the arrangement 10 as comprising five audio devices 12, 14, 16, 18, 20, one skilled in the art will appreciate that the various exemplary embodiments of the invention are not necessarily so limited and that any suitable number of audio devices (and/or speakers) may be provided. For example, in some embodiments of the invention, the arrangement 10 may comprise two audio devices where a first device is used to play back/output the front channels L, R, and a second device is used to play back/output the rear channels Ls (left surround), Rs (right surround). In some other embodiments of the invention, the arrangement 10 may comprise three audio devices arranged such that a first device plays back front L and R audio channels, a second device plays back rear audio channel Ls and video-L channel, and a third device plays back rear audio channel Rs and video-R channel. In yet another embodiment of the invention, the arrangement 10 may comprise four audio devices, wherein a first device plays back front L audio channel and left video-L channel, a second device plays back front audio channel R and right video-R channel, a third device plays back rear audio channel Ls, and a fourth device plays back rear audio channel Rs. Additionally, in other embodiments of the invention, the arrangement 10 may comprise more than five audio devices.

The arrangements mentioned above are exemplary of the set of audio devices which is discovered and selected for multi-channel playback according to these teachings. These are not intended to be comprehensive but rather serve as various examples of the possibilities which result from the various audio device arrangements. According to some embodiments of the invention, knowing this arrangement allows the audio system and audio devices to know what is the role of particular speakers in the whole system (for example, so one device can know that it is the right front channel speaker in the system of devices and another device can know that it is the left front channel speaker in the system of devices, etc.).

By determining locations of the audio devices, a mesh of speakers can be formed. Each audio device is a "node" and the distance between two nodes is a "path". Eventually, the path between each node is known and hence the arrangement of speakers can be found. The arrangement might be static or in some cases as with mobile terminals it may be dynamic, and so to account for the latter case in some implementations the audio device discovery is periodically or continuously updated.

In some embodiments such as where each audio device has the capability for direct radio communications with each other audio device (for example, they are each a mobile terminal handset), synchronous operation can be enabled by a single (master) mobile terminal allocating the audio channels to the different other audio devices/mobile terminals via radio-frequency signaling (for example, via Bluetooth/personal area network including Bluetooth Smart, wireless local area network WLAN/WiFi, ANT+, device-to-device D2D communications, or any other radio access technology which is available among the audio devices), and the different audio devices/mobile terminals then synchronously play out their respectively assigned audio channel for a much richer audio environment. Or in other embodiments each audio device has the identical multi-channel audio file and only plays out its respectively assigned or allocated audio channels synchronously with the other audio devices.

Synchronous play back or recording can be achieved when one device, termed herein as the 'master' device, provides a synchronization signal for that playback, or alternatively deciding what (third-party) signal will serve as the synchronization signal. For example, the master device may choose that a beacon broadcast by some nearby WiFi network will be the group-play synchronization signal. The master device will in this case send to the 'slave' audio devices some indication of what is to be the synchronization signal the various audio devices should all use for the group play back. Whether master or slave device is grounded in synchronization; it may be that the extent of control that the master device exercises over all of the other 'slave' audio devices is limited only to controlling timing of the audio file playback, which in the above examples is accomplished via selection of the synchronization signal.

In general, devices for smart environments benefit from having their physical location known, but even if low-cost Bluetooth based solutions for indoor navigation emerge in the market soon, and high-precision outdoor location is already available with differential GPS, it is impractical to implement them in every device, and also, it makes little engineering or economical sense to fit devices that are seldom moved with indoor navigation capabilities. According to various exemplary embodiments of the invention, one common use case where determining the location of devices with respect to the user's location is in multi-channel sound reproduction with loudspeakers, where at least the propagation delay, and possibly also sound level and/or equalization settings are adjusted to correspond to the distance between the user and the sound sources, and the channel selection generally conforms to the physical arrangement of the loudspeakers in the listening space (for example, left and right or front and back may not be reversed).

According to various exemplary embodiments of the invention, the location of each peripheral device is determined with an appropriate navigation system when the device is brought into a close proximity interaction (or near field communication) with a portable device. In some embodiments, the close proximity interaction may be a contact (or devices placed in close proximity to each other) determined with near field communications (NFC) or any other suitable short distance communication method. In some other exemplary embodiments of the invention, the close proximity interaction may be a contact that can be detected by tapping the object with the terminal device, so accelerometer or the microphone triggers the detection of the location of objects without near-field communication capabilities (room boundaries, conventional loudspeakers, for example) can be determined. The location information is stored then in the portable device, peripheral device, or both, and transmitted to other devices (such as, other loudspeakers, amplifier, for example). Also the listening location can be determined by the portable device, which can used for playback or which acts as a connection hub for the loudspeaker system. According to some embodiments of the invention, the basic settings (such as, delay and level, for example) are determined from the location information, and if the order of channels assigned to each loudspeaker does not correspond to the physical layout of the loudspeakers the channel assignments are changed accordingly. Additionally, more detailed direction information can be used to adjust the rendering of spatial audio (channel mixing, or object-based rendering). It should be noted that, according to various exemplary embodiments, the near field communication or contact can be determined by a near field communication (NFC) method, or one or more sensors. Additionally, the one or more sensors could be an accelerometer or a microphone, for example.

It should be noted that the term 'close proximity interaction' mentioned above and throughout the specification refers to any type of contact between the devices or placement between the devices such that they are in close proximity to each other. For example, close proximity interactions include tapping devices together, contacting devices together, as well as near field communications (NFC) or any other suitable short distance communication method between the devices.

Figure 2:
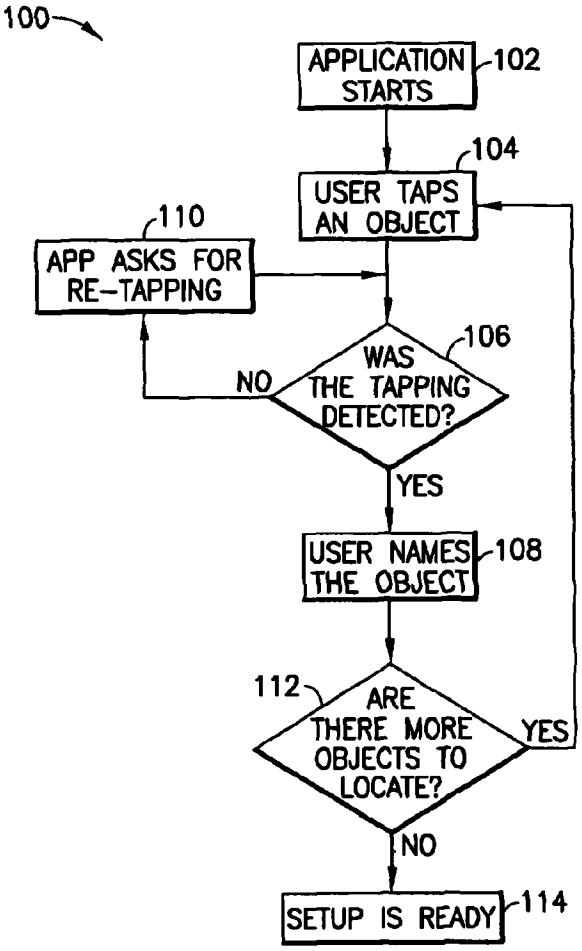
FIGS. 2 and 3 are block diagrams of exemplary methods incorporating features of the invention.

Referring now also to FIG. 2, there is shown a method 100 for location measurement by tapping according to various exemplary embodiments of the invention. Once the application starts (at block 102) [such as by user initiation], the user taps an object (at block 104). If the tapping was detected (at block 106), then the user goes on to name the object (at block 108) [Otherwise, the application asks for re-tapping at block 110]. Next the application asks if there are more objects to locate (at block 112). If there are more objects, then the application returns to block 104, otherwise, the setup is ready (block 114).

The method 100 provides a detection flowchart, or a loudspeaker setup, wherein the user assigns the channel and object information. FIG. 1 illustrates the results of the initial position measurement. The identity of one loudspeaker channel can be indicated by the user so that automatic assignment of signal channels to the loudspeakers is easy, or the user can be prompted to start from a certain speaker (such as, front right, for example).

Figure 3:
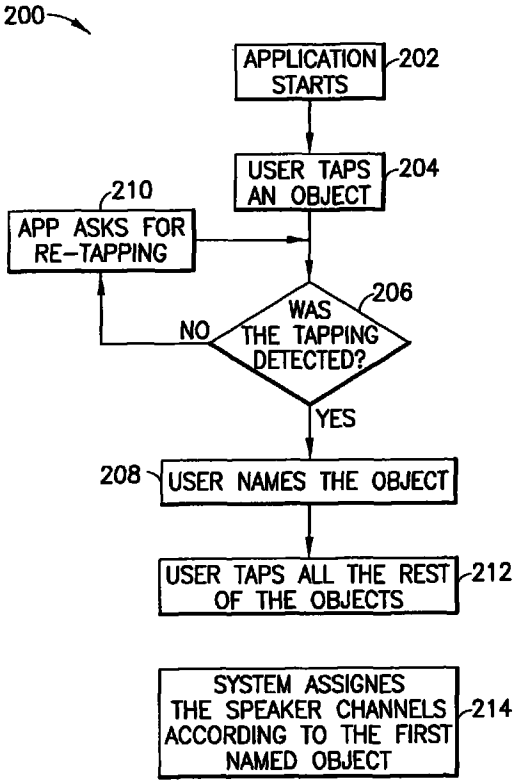

Referring now also to FIG. 3, there is shown a method 200 which provides for automatic channel assignment, and delay and angle estimation according to various exemplary embodiments of the invention. Once the application starts (at block 202) [such as by user initiation], the user taps an object (at block 204). If the tapping was detected (at block 206), then the user goes on to name the object (at block 208) [where this can be, for example, the loudspeaker channel, TV-set location, frontal direction, and so on], otherwise, the application asks for re-tapping at block 210. Next the user taps all the rest of the objects (at block 212). Followed by the system assigning the speaker channels according to the first named object (block 214).

Figure 4:
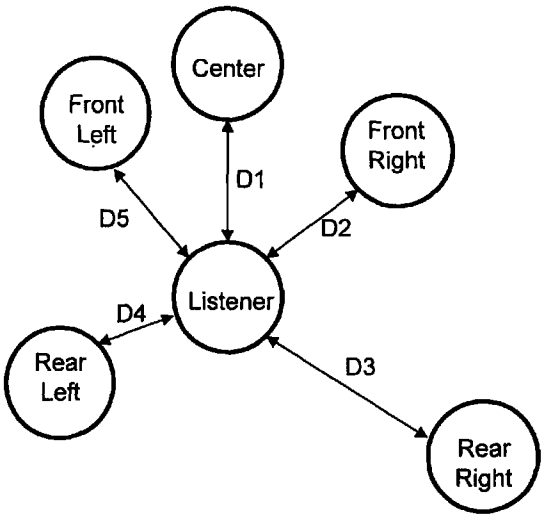
FIG. 4 is another schematic diagram of the exemplary arrangement of audio devices shown in FIG. 1.

The method 200 provides a detection flowchart, or a loudspeaker setup, wherein the system automatically assigns channel information to each loudspeaker based on their location. FIG. 4 illustrates the results of the automatic channel assignment based on one known channel and the geometric arrangement of the system, and of delay (or distance) calculation, wherein relative angles can be calculated.

Figure 5:
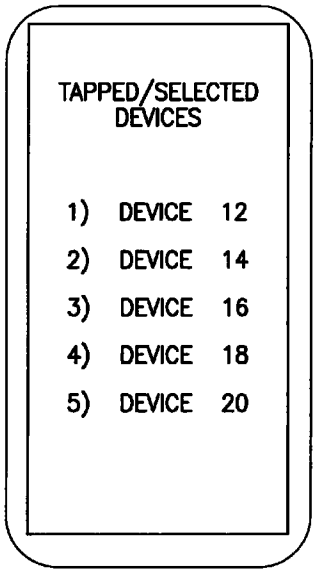
FIGS. 5 and 6 illustrate screen grabs from one of the devices shown in FIG. 1.
Figure 6:
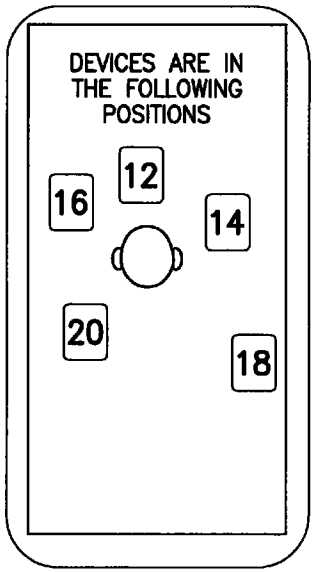

According to some embodiments of the invention, the application may display loudspeaker setup information on the master device. For example, FIGS. 5 and 6 show different screen grabs of the user interface of the master device which may run a locally-stored software application to implement these teachings. Following the method 100, 200, the application may provide for displaying the relative locations of each device, and the distances between each device. Where the master device has insufficient information for a given device it may discard such device from further consideration. For example, FIG. 5 shows the listing of all the discovered devices; in this example there are five discovered devices. However, in alternate embodiments, any suitable number of devices (such as, more than five devices, or less than five devices, for example) may be discovered. In some implementations there may be an option here for the user to exclude any of the listed devices from further consideration for the play back arrangement. This may be useful for example if the user knows that the sound quality from one of the devices is poor due to it having been dropped and damaged, or knows that the battery on the device is not sufficiently charged to be used for the whole duration of the play back.

According to some exemplary embodiments of the invention, the implementing application may find a 'best-fit' for play back from among those discovered devices (or from among whichever plurality of devices remain available for inclusion in the arrangement). For example, FIG. 6 shows the relative positions of all those discovered devices and that an arrangement match has been made. In this case all five discovered devices are in the play back arrangement, wherein the five devices will be allocated the directional channels L, Ls, C, R and Rs. It should be understood that FIGS. 5, 6 are not intended to be limiting in how information is displayed to a user, but rather is presented to explain various functions for how the arrangement choices are made in this non-limiting embodiment.

In general, there is an idealized spatial arrangement for 5:1 surround sound. Some exemplary embodiments of the invention, the implementing device selects which audio devices best fit the idealized spatial arrangement and selects those as members of the arrangement. The implementing device can of course select more devices than there are channels, for example if there were two devices found near the position of device 18, for example, the implementing device can select them both and allocate the same right surround channel to them both. If for example the file to be played back is 5:1 surround sound but the implementing device finds only three devices, the spatial effect to be presented will be 3:1 surround sound because 5:1 is not possible given the discovered devices. For the more specific embodiment where the arrangement is selected for a best fit to an idealized spatial arrangement for achieving the intended spatial audio effect, in this example the best fit may then be 3:1 surround sound so the best fit for the case of play back does not have to match the multi-channel profile of the file that is to be played back.

For the case of multi-channel recording, the implementing device selects a type or profile of the multi-channel file as the spatial audio effect it would like the recording to present, such as for example stereo or 5:1 surround sound. For example, the implementing device may choose the spatial audio effect it would like to achieve based on what is the spatial arrangement of the devices it discovers. The implementing device may find there are several possible arrangements, and in the more particular 'best fit' embodiment choose the 'best fit' as the one which is deemed to record the richest audio environment. If there are only 4 devices found but their spatial arrangement is such that the best fit is 3:1 surround sound (L, C and R channels), the master device may then choose 3:1 and allocate channels accordingly.

Figure 7:
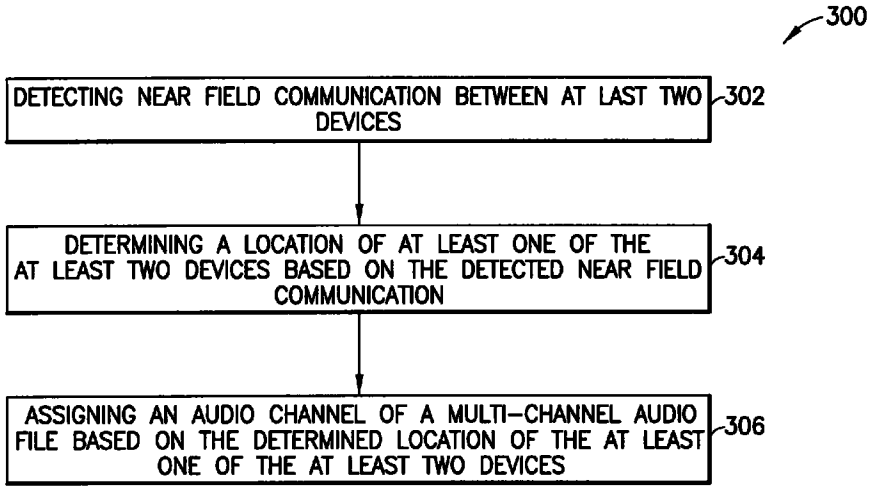
FIG. 7 is a block diagram of an exemplary method incorporating features of the invention.

FIG. 7 illustrates a method 300. The method 300 includes detecting near field communication between at least two devices (at block 302). Determining a location of at least one of the at least two devices based on the detected near field communication (at block 304). Assigning an audio channel of a multi-channel audio file based on the determined location of the at least one of the at least two devices (at block 306). It should be noted that the illustration of a particular order of the blocks does not necessarily imply that there is a required or preferred order for the blocks and the order and arrangement of the blocks may be varied. Furthermore it may be possible for some blocks to be omitted.

Additionally, in some exemplary embodiments, the method may further include determining, based on the detected near field communication, a location of at least one of: one of the at least two devices; one or more other devices using one of the at least two devices; and the other of the at least two devices. For example, according to some embodiments, the multi-channel audio file is assigned based on the detected loudspeakers in example embodiments but the actual portable device (for example, the mobile phone) may be just used for detecting and assigning audio channels to other detected devices/loudspeakers. The portable device (mobile phone) may not be used for audio playback in alternative embodiments. According to some embodiments, if a first device is a portable device (such as a mobile phone, for example) and then a second device is a loudspeaker, then the location the first device is not generally determined (apart from the determination of the listening position) as the location of the portable device continuously changes, such as when the user taps a first loudspeaker and then a second loudspeaker and then third so on, for example. In some alternative embodiments, the first device location may be important if the phone is used for sound reproduction. In these alternative embodiments, then when the method comprises determining, based on the detected near field communication, a location of one of the at least two devices, this may correspond to a loudspeaker location detected, for example. When the method comprises determining, based on the detected near field communication, a location of one or more other devices using one of the at least two devices, this may correspond to one or more other loudspeaker locations detected, for example. When the method comprises determining, based on the detected near field communication, a location of the other of the at least two devices, this may correspond to portable device location detected, for example.

Various exemplary embodiments of the invention provide for discovering the physical positions of different loudspeakers relative to one another, and then selecting an arrangement of those loudspeakers that is appropriate for playing back a multi-channel audio file, the arrangement has multiple distinct speakers, each outputting different channels of the unitary multi-channel audio file. However it should be noted that the speakers are not required to output only in the audible range. For example in some embodiments, the speakers could include metadata in the inaudible range (such as, above 20 kHz, for example), wherein there is provided the use of sub-bands to transmit the metadata alongside the audio. Examples for the metadata could include, for example, general data transfer, speaker identification, sync signaling, distance estimation/confirmation, and distance change detection. Additionally, as the signaling is done in the inaudible audio range, it can happen simultaneously with the audio playback.

Figure 8:
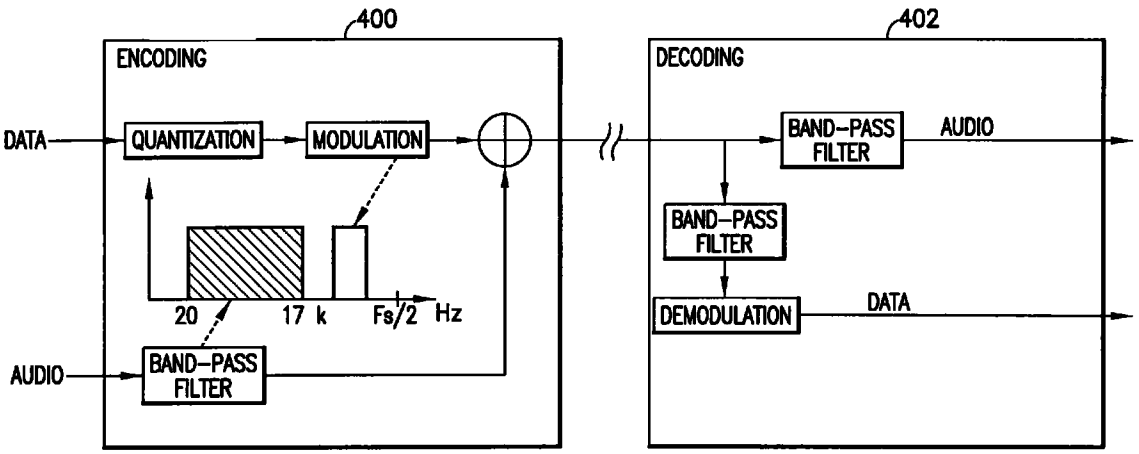
FIG. 8 is a block diagram illustrating encoding and decoding in accordance with features of the invention.

Referring now also to FIG. 8, there is shown an example embodiment using high frequencies for data encoding (sub-band coding). In this example embodiment, encoding and decoding is illustrated at 400, 402. At block 400, quantization and modulation of the data is illustrated, while the audio is filtered at a band-pass filter. At block 402, the audio and data is filtered through another band-pass filter(s), and the data is further demodulated. The metadata can be encoded in a frequency band below or above useful audio content. Additionally, according to some embodiments of the invention, the frequency bands can also be out of human hearing range. With higher sampling rate (such as, greater than 44.1 kHz, for example) there is lot of available frequency band above human hearing range (such as, greater than 17 kHz, for example). Further, in some embodiments, the modulation method can be chosen based on the system.

Figure 9:
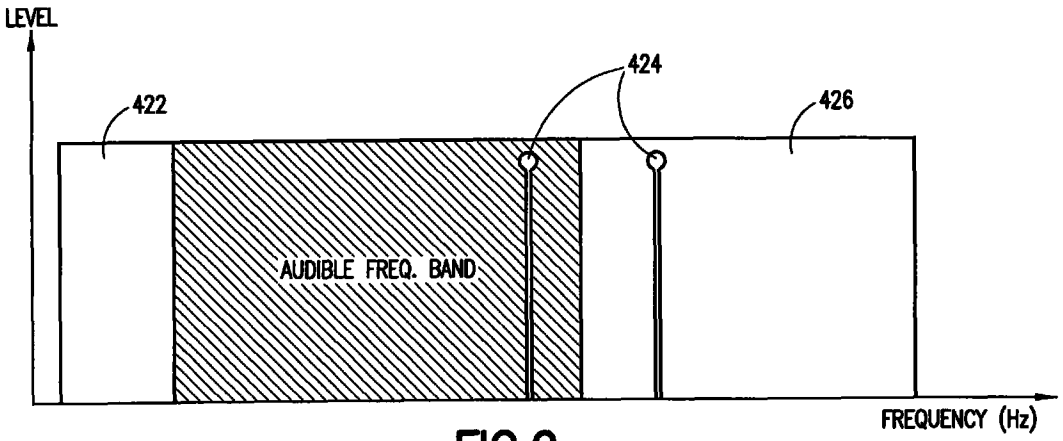
FIG. 9 is a plot illustrating different bands for modulation in accordance with features of the invention.

Referring now also to FIG. 9, there can be separate cases for different bands available for modulation including low frequencies 422, single frequencies 424, and high frequencies 426. For example, as shown at 422 the lowest frequency band (such as, less than 20 Hz, for example) can be used for data modulation, as shown at 424 single frequency components can be used for data coding, and as shown at 426 the frequency band beyond human hearing (such as, greater than about 17 kHz, for example) can be used for data coding. However, in alternate embodiments, any other suitable band(s) may be available for modulation.

Figure 10:
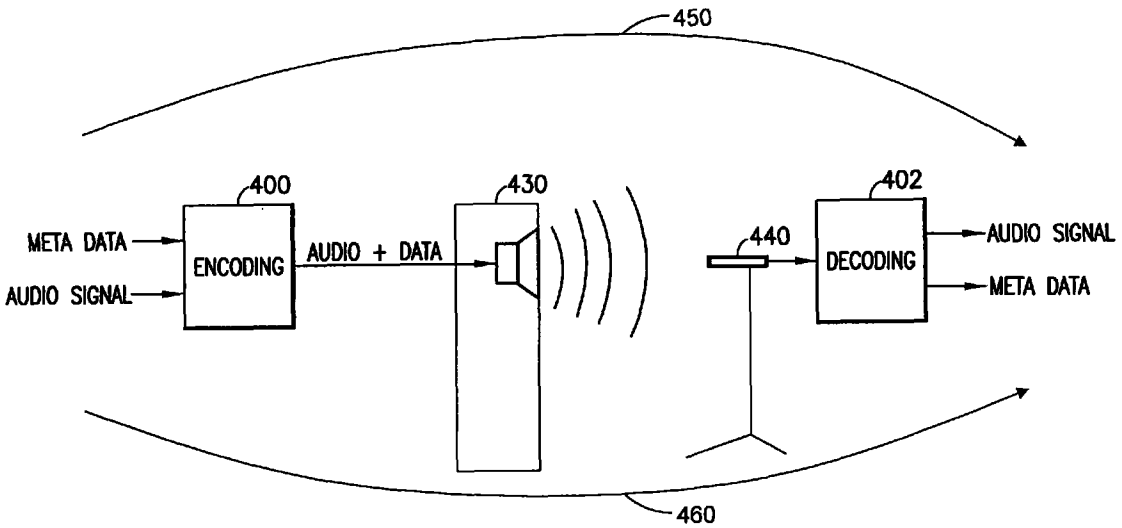
FIG. 10 is a schematic representation of an example use case for spatialized audio incorporating features of the invention.

Referring now also to FIG. 10, an example use case for spatialized audio is illustrated, wherein the encoding 400 of the metadata and the audio signal is provided to the loudspeaker, and decoding 402 of the audio and data emitted by the loudspeaker 430 is provided after received by the microphone 440. According to some embodiments, the metadata could include, frequency range information, transducer temperature, and/or real-time dynamic headroom, for example. Additionally at 450, the metadata could be used to, control the cross-over network, and/or dynamically control dynamics, for example. According to some embodiments, the audio signal can be, a measurement signal from the audio amplifier, or even music or movie program material, foe example. Additionally at 460, the measurement signal is processed as usual.

Technical effects of any one or more of the exemplary embodiments provide a location based loudspeaker system configuration providing various advantages when compared to conventional configurations. Many of the conventional configurations use adjustment of multi-channel audio systems based on acoustical measurement of the transfer function between the loudspeakers and a microphone (system) in the listening location. In the conventional configurations this measurement is time-consuming, and some embedded systems suffer from reliability problems. Also, the basic acoustical measurements often rely on only one microphone, and thus are unable to determine the directions of the loudspeakers with respect to the listening position.

Without in any way limiting the scope, interpretation, or application of the claims appearing below, a technical effect of one or more of the example embodiments disclosed herein is that in multi-channel audio reproduction the information about system geometry is more precise and reliable than with sound-based system measurement. Although various exemplary embodiments may require some user interaction, it is still fast as compared to the conventional methods. Room geometry information can be used as initial data for more advanced room correction or measurement systems. However, the information does not take into account the acoustics of the loudspeakers and the listening room, so further corrections may be used, but the location based information is useful as a baseline even if additional acoustical measurements are used.

Another technical effect of one or more of the example embodiments disclosed herein is to provide for a location based loudspeaker system configuration to determine the speaker locations in a room or a listening area. Another technical effect of one or more of the example embodiments disclosed herein is related to multi-channel audio playback configuration wherein the playback geometry comprising the location of playback devices and the listening position are determined based on near field communication so as to reproduce optimized audio channels based on the known locations.

Another technical effect of one or more of the example embodiments disclosed herein is that the nodes (speakers) need not be active in order determine the arrangement/constellation, for example, any surface of the device/speaker can be located. Another technical effect of one or more of the example embodiments disclosed herein is that the channel order may be locked by assigning one speaker channel, for example, in the phone UI, while tapping the speaker location, wherein all the other speaker channels can be assigned optimally based on this one channel information. Furthermore, by tapping the listening position, the speaker channel assignment optimization can be further improved. Another technical effect of one or more of the example embodiments disclosed herein is that audio signaling to determine speaker locations is not needed/required. Another technical effect of one or more of the example embodiments disclosed herein is that the device/speaker does not need any extra features (such as a speaker having active multiple microphones and required DSP capabilities [for beamforming]), and any "dummy" object can be located.

Another technical effect of one or more of the example embodiments disclosed herein is the speaker arrangement/constellation estimation does not require active elements in the speaker, and/or additional software in the phone/device (such as various types of detection software). Various exemplary embodiments of the invention use the phone's, already existing, location information and assign that to different physical (or even virtual) objects, which allows locating any object in the environment. The accuracy of the system is determined by the accuracy of the phone's (indoor) positioning accuracy.

The above teachings may be implemented as a stored software application and hardware that allows the several distinct mobile devices to be configured to make a synchronized stereo/multichannel recording or play back together, in which each participating device contributes one or more channels of the recording or of the play back. In a similar fashion, a 3D video recording can be made using cameras of the various devices in the arrangement, with a stereo base that is much larger than the maximum dimensions of any one of the individual devices. Any two participating devices that are spaced sufficiently far apart could be selected for the arrangement of devices that will record the three dimensional video.

According to some embodiments of the invention, there may be one application running on the master device only, which controls the other slave devices to play out or record the respective channel that the master device assigns. Or in other embodiments some or all of the participating devices are each running their own application which aids in determining speaker and/or listener locations in the room.

In some embodiments of the invention, such as for the case of play back the slave devices can get the whole multi-channel file, or only their respective channel(s), from the master device. For the case of recording each can learn their channel assignments from the master device, and then after the individual channels are recorded they can send their respectively recorded channels to the master device for combining into a multi-channel file, or all the participating devices can upload their respective channel recordings to a web server which does the combining and makes the multi-channel file available for download.

The various participating devices do not need to be of the same type. If the arrangement of devices are not all of the same model it is inevitable that there will be frequency response and level differences between them, but these may be corrected automatically by the software application; for recording by the devices these corrections can be done during mixing of the final multi-channel recording, and for play back these can be done even dynamically using the microphone of mobile-terminal type devices to listen to the acoustic environment during play back and dynamically adjust amplitude or synthesis of their respective channel play back because any individual device knowing the arrangement and distances can estimate how the sound environment should sound be at its own microphone.

Figure 11:
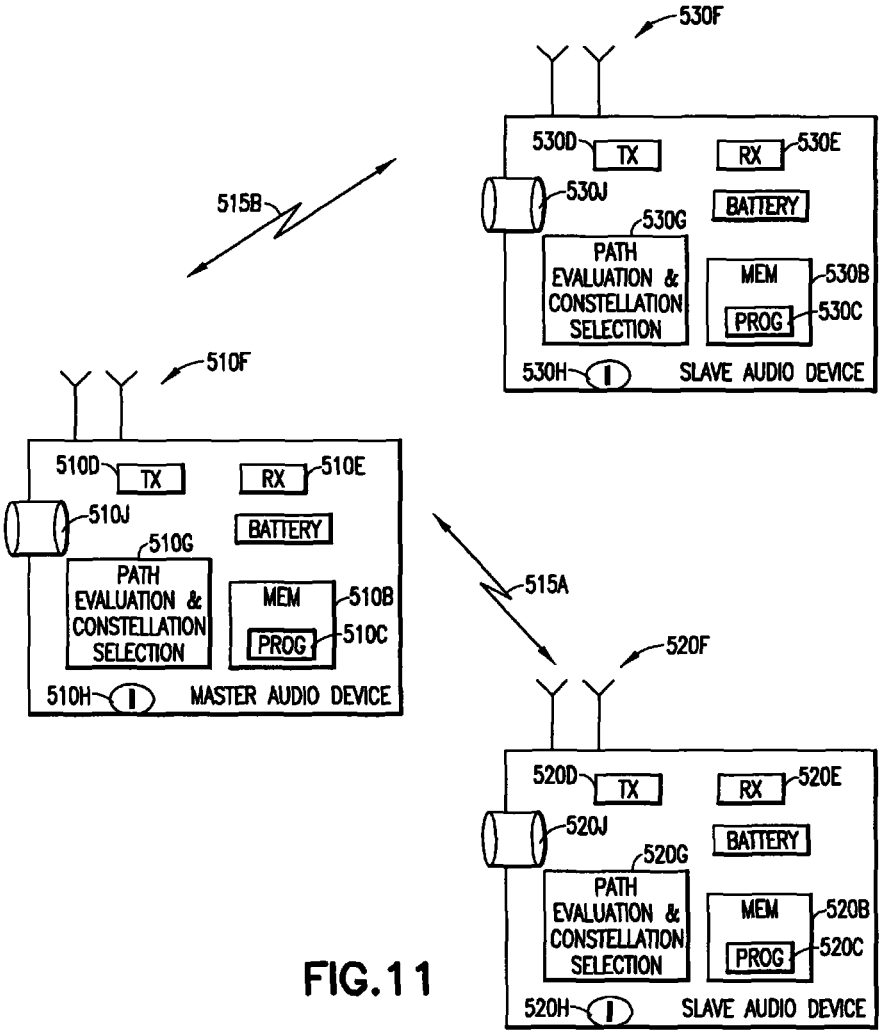
FIG. 11 is a schematic block diagram of three devices incorporating features of the invention.

The master device and the other participating devices may for example be implemented as user mobile terminals or more generally referred to as user equipments UEs. FIG. 11 illustrates by schematic block diagrams a master device implemented as audio device 510, and two slave devices implemented as audio devices 520 and 530. The master audio device 510 and slave audio devices 520, 530 are wirelessly connected over a bidirectional wireless links 515A, 515B which may be implemented as Bluetooth, wireless local area network, device-to-device, or even ultrasonic or sonic links, to name a few exemplary but non-limiting radio access technologies. In each case these links are direct between the devices 510, 520, 530 for the device discovery and path information.

At least the master audio device 510 includes a controller, such as a computer or a data processor (DP) 510A, a computer-readable memory (MEM) 510B that tangibly stores a program of computer-readable and executable instructions (PROG) 510C such as the software application detailed in the various embodiments above, and in embodiments where the links 515A, 515B are radio links also a suitable radio frequency (RF) transmitter 510D and receiver 510E for bidirectional wireless communications over those RF wireless links 515A, 515B via one or more antennas 510F (two shown). The master audio device 510 may also have a Bluetooth, WLAN or other such limited-area network module whose antenna may be inbuilt into the module, which in FIG. 11 is represented also by the TX 510D and RX 510E. The master audio device 510 additionally may have one or more microphones 510H and in some embodiments also a camera 510J. All of these are powered by a portable power supply such as the illustrated galvanic battery.

The illustrated slave audio devices 520, 530 each also includes a controller/DP 520A/530A, a computer-readable memory (MEM) 520B/530B tangibly storing a program computer-readable and executable instructions (PROG) 520C/530C (a software application), and a suitable radio frequency (RF) transmitter 520D/530D and receiver 520E/530E for bidirectional wireless communications over the respective wireless links 515A/515B via one or more antennas 520F/530F. The slave audio devices 520, 530 may also have a Bluetooth, WLAN or other such limited-area network module and one or more microphones 520H/530H and possibly also a camera 520J/530J, all powered by a portable power source such as a battery.

At least one of the PROGs in at least the master device 510 but possibly also in one or more of the slave devices 520, 530 is assumed to include program instructions that, when executed by the associated DP, enable the device to operate in accordance with the exemplary embodiments of this invention, as detailed above. That is, the exemplary embodiments of this invention may be implemented at least in part by computer software executable by the DP of the master and/or slave devices 510, 520, 530; or by hardware, or by a combination of software and hardware (and firmware).

In general, the various embodiments of the audio devices 510, 520, 530 can include, but are not limited to: cellular telephones; personal digital assistants (PDAs) having wireless communication and at least audio recording and/or play back capabilities; portable computers (including laptops and tablets) having wireless communication and at least audio recording and/or play back capabilities; image capture and sound capture/play back devices such as digital video cameras having wireless communication capabilities and a speaker and/or microphone; music capture, storage and playback appliances having wireless communication capabilities; Internet appliances having at least audio recording and/or play back capability; audio adapters, headsets, and other portable units or terminals that incorporate combinations of such functions.

The computer readable MEM in the audio devices 510, 520, 530 may be of any type suitable to the local technical environment and may be implemented using any suitable data storage technology, such as semiconductor based memory devices, flash memory, magnetic memory devices and systems, optical memory devices and systems, fixed memory and removable memory. The DPs may be of any type suitable to the local technical environment, and may include one or more of general purpose computers, special purpose computers, microprocessors, digital signal processors (DSPs) and processors based on a multicore processor architecture, as non-limiting examples.

In general, the various exemplary embodiments may be implemented in hardware or special purpose circuits, software, logic or any combination thereof. For example, some aspects may be implemented in hardware, while other aspects may be implemented in embodied firmware or software which may be executed by a controller, microprocessor or other computing device, although the invention is not limited thereto. While various aspects of the exemplary embodiments of this invention may be illustrated and described as block diagrams, flow charts, or using some other pictorial representation, it is well understood that these blocks, apparatus, systems, techniques or methods described herein may be implemented in, as non-limiting examples, hardware, embodied software and/or firmware, special purpose circuits or logic, general purpose hardware or controller or other computing devices, or some combination thereof, where general purpose elements may be made special purpose by embodied executable software.

It should thus be appreciated that at least some aspects of the exemplary embodiments of the inventions may be practiced in various components such as integrated circuit chips and modules, and that the exemplary embodiments of this invention may be realized in an apparatus that is embodied as an integrated circuit. The integrated circuit, or circuits, may comprise circuitry (as well as possibly firmware) for embodying at least one or more of a data processor or data processors, a digital signal processor or processors, and circuitry described herein by example.

It should be understood that components of the invention can be operationally coupled or connected and that any number or combination of intervening elements can exist (including no intervening elements). The connections can be direct or indirect and additionally there can merely be a functional relationship between components.

As used in this application, the term 'circuitry' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

In one exemplary embodiment, a method comprising detecting close proximity interactions; determining locations of a plurality of devices based on the detected close proximity interactions; and assigning a channel of a multi-channel audio file based on the determined locations of the plurality of devices.

A method as above, wherein the close proximity interactions comprise short distance communication methods.

A method as above, wherein the close proximity interactions comprise near field communications.

A method as above, wherein the close proximity interactions comprise tapping or contacting devices.

A method as above, further comprising reproducing optimized audio channels based on the determined locations of the plurality of devices.

A method as above, wherein further comprising determining a listening location relative to the determined locations of the plurality of devices.

A method as above, further comprising determining distances between the listening location and the plurality of devices.

A method as above, wherein the assigning of the channel further comprises assigning a center sound channel, a right front sound channel, a left front sound channel, a right surround sound channel, or a left surround sound channel.

A method as above, wherein each one of the plurality of devices comprises an audio device having at least one speaker.

In another exemplary embodiment, a method comprising detecting near field communication between at least two devices; determining a location of at least one of the at least two devices based on the detected near field communication; and assigning an audio channel of a multi-channel audio file based on the determined location of the at least one of the at least two devices.

A method as above, further comprising determining, based on the detected near field communication, a location of at least one of: one of the at least two devices; one or more other devices using one of the at least two devices; and the other of the at least two devices.

A method as above, further comprising assigning audio channels of the multi-channel audio file based on the determined location of at least one of the at least two devices and/or the one or more other devices.

A method as above, wherein the near field communication comprises tapping or contacting devices.

A method as above, further comprising reproducing optimized audio channels based on the determined location of the at least one of the at least two devices.

A method as above, further comprising determining a listening location relative to the determined location of the at least one of the at least two devices.

A method as above, further comprising determining a distance between the listening location and the at least one of the at least two devices.

A method as above, wherein the assigning of the channels further comprises assigning a center sound channel, a right front sound channel, a left front sound channel, a right surround sound channel, or a left surround sound channel.

A method as above, wherein each one of the at least two devices comprises an audio device having at least one speaker.

A method as above, wherein the determined location is stored and transmitted.

A method as above, wherein each one of the at least two devices comprises an audio system having at least one speaker.

In another exemplary embodiment, an apparatus comprising: at least one processor; and at least one memory including computer program code, the at least one memory and the computer program code configured to, with the at least one processor, cause the apparatus to perform at least the following: detect near field communication; determine a location of a device based on the detected near field communication; and assign a channel of a multi-channel audio file based on the determined location of the device.

An apparatus as above, wherein the at least one memory and the computer program code are further configured to, with the at least one processor, cause the apparatus to determine a listening location relative to the determined location of the device.

An apparatus as above, wherein the apparatus comprises a mobile device, and wherein the listening location is determined by the mobile device.

An apparatus as above, wherein the at least one memory and the computer program code are further configured to, with the at least one processor, cause the apparatus to determine a distance between the listening location and the device.

An apparatus as above, wherein the device comprises at least two devices, and wherein the at least one memory and the computer program code are further configured to, with the at least one processor, cause the apparatus to the determine, based on the detected near field communication, a location of at least one of: one of the at least two devices; one or more other devices using one of the at least tow devices; and the other of the at least two devices.

An apparatus as above, wherein the at least one memory and the computer program code are further configured to, with the at least one processor, cause the apparatus to assign channels of the multi-channel audio file based on the determined location of at least one of the at least two devices and/or the one or more other devices.

An apparatus as above, wherein the near field communication comprises tapping or contacting devices.

An apparatus as above, wherein each one of the devices comprises an audio system having at least one speaker.

An apparatus as above, wherein the near field communication comprises one of: a near field communication (NFC) method, or one or more sensors.

In another exemplary embodiment, a computer program product comprising a non-transitory computer-readable medium bearing computer program code embodied therein for use with a computer, the computer program code comprising: code for detecting near field communication; code for determining a location of a device based on the detected near field communication; and code for assigning a channel of a multi-channel audio file based on the determined location of the device.

A computer program product as above, further comprising code for determining locations of at least two devices based on the detected near field communication.

A computer program product as above, wherein the near field communication comprises tapping or contacting devices.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A method, comprising:

detecting near field communication between at least two devices;

defining one of the at least two devices as a playback device based, at least partially, on the detected near field communication;

determining, with a processor, a dynamic location of at least the playback device relative to a user selected listening position defined by the other of the at least two devices in response to the detected near field communication;

in response to a tapping of the playback device, assigning, with the processor, a first respective audio channel of a multi-channel audio file based on the determined dynamic location of the playback device so as to adjust a playback setting for the assigned respective first audio channel relative to the user selected listening position;

assigning, with the processor, a second respective audio channel of the multi-channel audio file based on the tapping of the playback device; and reproducing an adjusted respective audio channel by the playback device based on the determined dynamic location of at least the playback device relative to the user selected listening position.

2. The method of claim 1 wherein the near field communication comprises tapping or contacting devices.

3. The method of claim 1 further comprising determining a distance between the listening location and the at least one of the at least two devices.

4. The method of claim 1 wherein the assigning of the channel further comprises assigning at least one of: a center sound channel, a right front sound channel, a left front sound channel, a right surround sound channel, or a left surround sound channel.

5. The method of claim 1 wherein the near field communication comprises one of: a near field communication (NFC) method, or one or more sensors.

6. The method of claim 1 wherein the determined location is stored and transmitted.

7. The method of claim 1 wherein each one of the at least two devices comprises an audio system having at least one speaker.

8. The method of claim 1 wherein the playback device is configured to provide at least a portion of a synchronized multichannel sound reproduction and/or a synchronized multichannel recording.

9. The method of claim 1 wherein the playback device is configured to transmit metadata in an inaudible audio range.

10. The method of claim 1 wherein the at least two devices are configured to record three dimensional (3D) video.

11. The method of claim 1 wherein the playback setting comprises at least one of: a propagation delay, a sound level, and an amplitude.

12. An apparatus, comprising:

at least one processor; and at least one non-transitory memory including computer program code the at least one non-transitory memory and the computer program code configured to, with the at least one processor, cause the apparatus to perform at least the following:

detect near field communication between at least two devices;

define one of the at least two devices as a playback device based, at least partially, on the detected near field communication;

determine a dynamic location of at least the playback device relative to a user selected listening position defined by the other of the at least two devices in response to the detected near field communication;

in response to a tapping of the playback device, assign a first respective audio channel of a multi-channel audio file based on the determined dynamic location of the playback device so as to adjust a playback setting for the assigned respective first audio channel relative to the user selected listening position;

assign, with the processor, a second respective audio channel of the multi-channel audio file based on the tapping of the playback device; and reproduce an adjusted respective audio channel by the playback device based on the determined dynamic location of at least the playback device relative to the user selected listening position.

13. The apparatus of claim 12 wherein the apparatus comprises a mobile device, and wherein the listening location is determined by the mobile device.

14. The apparatus of claim 12 wherein the at least one non-transitory memory and the computer program code are further configured to, with the at least one processor, cause the apparatus to determine a distance between the listening location and the device.

15. The apparatus of claim 12 wherein the near field communication comprises tapping or contacting devices.

16. The apparatus of claim 15 wherein each one of the devices comprises an audio device having at least one speaker.

17. The apparatus of claim 12 wherein the near field communication comprises one of: a near field communication (NFC) method, or one or more sensors.

18. The apparatus of claim 12 wherein the playback device is configured to provide at least a portion of a synchronized multichannel sound reproduction and/or a synchronized multichannel recording.

19. The apparatus of claim 12 wherein the playback device is configured to transmit metadata in an inaudible audio range.

20. The apparatus of claim 12 wherein the at least two devices are configured to record three dimensional (3D) video.

* * * * *